US005560416A

United States Patent [19]

Yu

[11] Patent Number: 5,560,416

[45] Date of Patent: Oct. 1, 1996

[54] MODULAR SHUTTER WITH JUXTAPOSED SLATS FOR A CABINET

[76] Inventor: Jackson Yu, 2F, No. 2, Chung-Hua St., Pei-Tou Dist., Taipei, Taiwan

[21] Appl. No.: 327,416

[22] Filed: Oct. 21, 1994

[51] Int. Cl.[6] ..... E06B 3/48; E06B 9/15; E05D 15/00

[52] U.S. Cl. ..... 160/229.1; 160/36; 160/214; 160/235; 312/294; 312/297

[58] Field of Search ..... 160/36, 37, 229.1, 160/232, 235, 214; 312/297, 294

[56] References Cited

U.S. PATENT DOCUMENTS

| | | | |
|---|---|---|---|
| 4,042,005 | 8/1977 | Hammerstein | 160/220 |
| 4,345,635 | 8/1982 | Solomon | 160/133 |
| 4,690,193 | 9/1987 | Morrison et al. | 160/133 |
| 4,709,640 | 12/1987 | Jouanin | 108/91 |
| 4,723,588 | 2/1988 | Ruppel | 160/236 |
| 5,236,260 | 8/1993 | Yu | 312/297 |

*Primary Examiner*—Blair Johnson
*Assistant Examiner*—Bruce A. Lev
*Attorney, Agent, or Firm*—Oblon, Spivak, McClelland, Maier & Neustadt, P.C.

[57] ABSTRACT

A shutter for a cabinet includes a plurality of juxtaposed slats with front and rear sides. Each of the slats has longitudinal first and second portions, a longitudinal intermediate portion between the first and second portions, and a pin-and-eye assembly provided on the rear side at the first and second portions for connecting pivotally adjacent ones of the slats. Each of the slats further has a transparent part. The intermediate portion of the transparent part has a convex surface.

13 Claims, 4 Drawing Sheets

MODULAR SHUTTER WITH JUXTAPOSED SLATS FOR A CABINET

BACKGROUND OF THE INVENTION

1. Field of the Invention

The invention relates to a shutter for a cabinet, more particularly to a modular shutter with a plurality of juxtaposed slats which have transparent slat parts through which an object behind the shutter can be viewed.

2. Description of the Related Art

U.S. Pat. No. 5,236,260 discloses a drawable shutter for closing an entrance of a cabinet, such as one for receiving compact discs, cassette tapes and the like, therein. Each of the slats has front and rear sides and includes longitudinal upper and lower portions, a longitudinal intermediate portion between the upper and lower portions, a longitudinal rib projecting from the rear side at the intermediate portion, and a pin-and-eye assembly with a pin member provided on the rear side at the upper portion and extending in a direction substantially parallel to the rib and an eye member provided on the rear side at the lower portion. The pin member of one of the slats engages the eye member of an adjacent one of the slats so as to pivotally connect the same. When the shutter is installed, no clearance is formed between adjacent slats to prevent dust from entering into-the-cabinet.

It is noted that the slats are made of an opaque material and have no transparent parts to permit viewing of objects behind the shutter, thereby making it difficult to identify the objects kept in the cabinet.

Although it is possible to form the slats of the above described shutter entirely from a transparent material, such slats are incapable of magnifying the objects behind the shutter. In addition, the aesthetic appeal of the cabinet is diminished when a shutter with slats that are formed entirely from a transparent material is installed.

SUMMARY OF THE INVENTION

Therefore, the object of the present invention is to provide a shutter with juxtaposed slats for a cabinet, the slats being partially transparent and permitting magnified viewing of objects kept behind the shutter so as to facilitate identification of the objects while enhancing aesthetic appeal of the cabinet.

Accordingly, the shutter of the present invention is to be installed in a cabinet and comprises a plurality of juxtaposed slats with front and rear sides. Each of the slats has longitudinal first and second portions, a longitudinal intermediate portion between the first and second portions, and a pin-and-eye assembly provided on the rear side at the first and second-portions for connecting pivotally adjacent ones of the slats. Each of the slats further has a transparent part. The intermediate portion of the transparent part has a convex surface.

Preferably, the transparent parts of adjacent ones of the slats are aligned with one another, and the convex surface is at the front side of the slat.

In one aspect of the present invention, each of the slats includes at least two longitudinally aligned slat parts with front and rear sides. Each of the slat parts has longitudinal first and second portions, a longitudinal intermediate portion between the first and second portions, a pin-and-eye assembly provided on the rear side at the first and second portions for connecting pivotally adjacent ones of the slats, and complementary finest and second connectors formed at two end portions for connecting adjacent ones of the slat parts of one slat. At least one of the slat parts of each of the slats is transparent, and the intermediate portion of the transparent slat part has a convex surface.

The pin-and-eye assembly includes a pin member provided at the first portion and extending in a longitudinal direction of the slat part and an eye member provided at the second portion. The pin member of one of the slat parts of one of the slats engages the eye member of one of the slat parts of an adjacent one of the slats to connect pivotally the slats.

The first connector includes a hook member which extends in a longitudinal direction of the slat part from one of the end portions, and the second connector includes a hook seat which is formed at the other one of the end portions and which engages the hook member of an adjacent one of the slat parts of the slat.

The first connector further includes a tenon which extends in the longitudinal direction from one of the end portions, and the second connector further includes a mortise which is formed in the other one of the end portions and which engages the tenon of the adjacent one of the slat parts of the slat.

BRIEF DESCRIPTION OF THE DRAWINGS

Other features and advantages of the present invention will become apparent in the following detailed description of the preferred embodiment with reference to the accompanying drawings, of which.

DESCRIPTION OF THE PREFERRED EMBODIMENT

Figure 1:
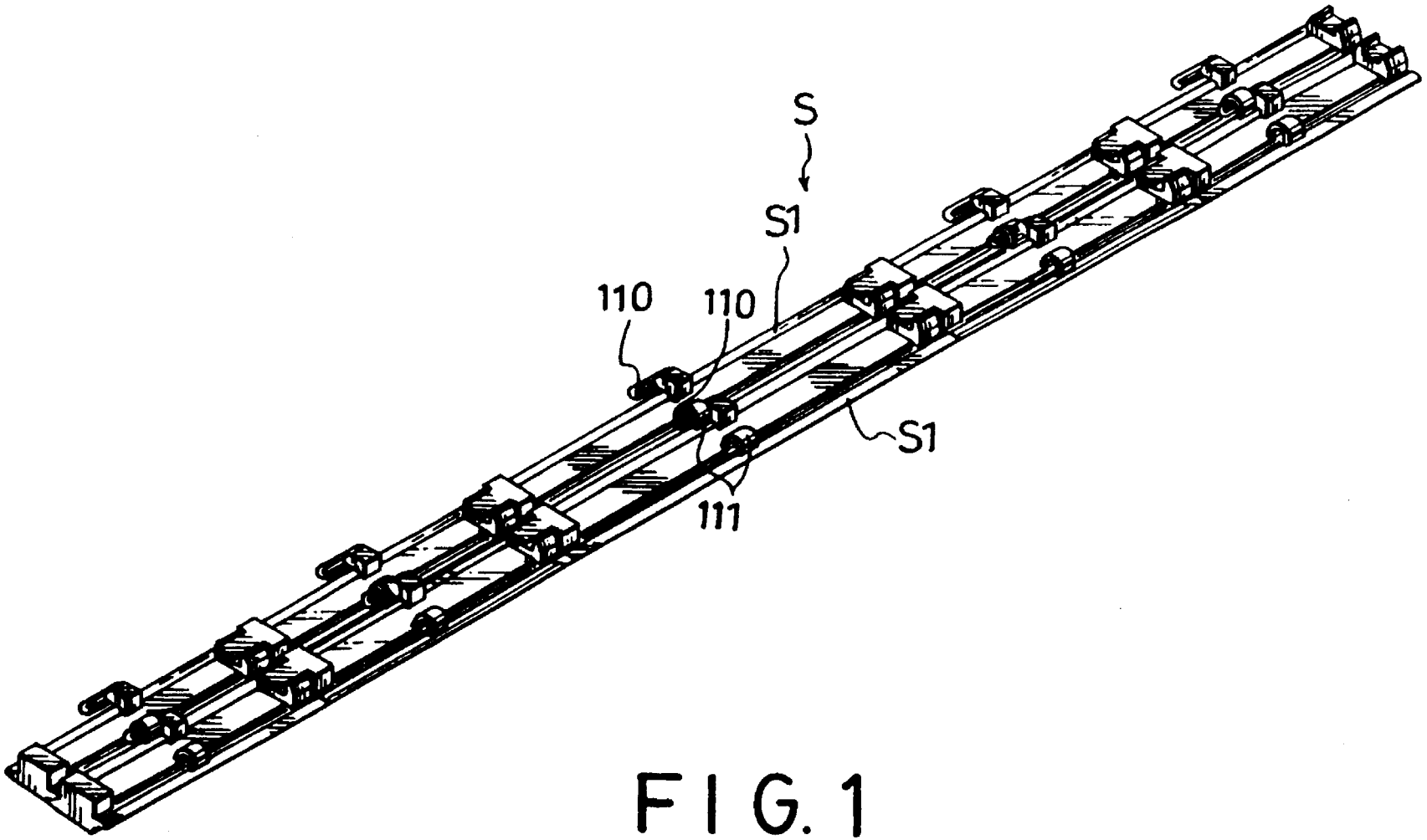
FIG. 1 is a rear perspective view illustrating a part of the preferred embodiment of a shutter according to the present invention.
Figure 4:
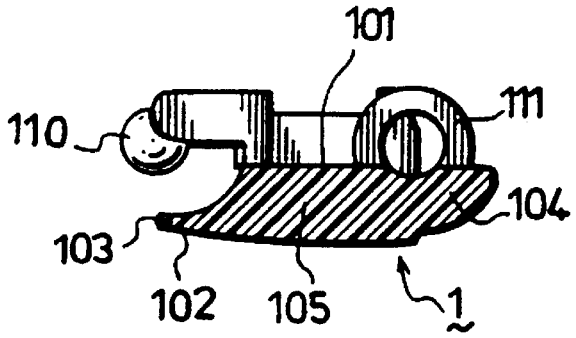
FIG. 4 is a sectional view of the slat part, taken along line IV—IV in FIG. 3.
Figure 5:
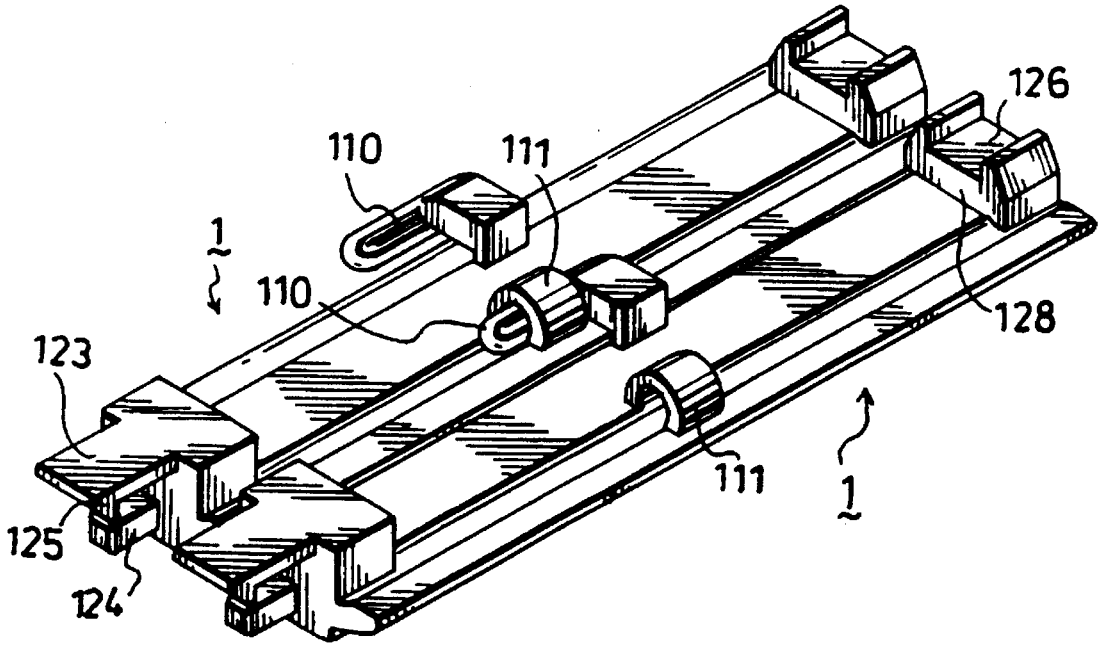
FIG. 5 is a rear perspective view illustrating how two slats of the preferred embodiment are connected pivotally.

Referring to FIGS. 1 to 5, the preferred embodiment of a shutter (S) according to the present invention is shown to comprise a plurality of juxtaposed slats (S1) (only two slats are shown in FIG. 1). Each of the slats (S1) comprises a plurality of slat parts 1A, 1B with front and rear sides, 102 and 101. Each of the slat parts has longitudinal first and second portions, 103 and 104, a longitudinal intermediate portion 105 between the first and second portions, 103 and 104, and a pin-and-eye assembly 11 provided on the rear side 101 at the first and second portions, 103 and 104, for connecting pivotally adjacent slats (S1). The pin-and-eye assembly 11 includes a pin member 110 provided at the first portion 103 and extending in a longitudinal direction of the slat part 1 and an eye member 111 provided at the second portion 104. The pin member 110 of one of the slat parts 1A, 1B engages the eye member 111 of the slat part 1 of an adjacent one of the slats (S1) so as to connect pivotally the slats (S1), as shown in FIG. 5.

Each of the slat parts 1 further has a connecting unit 12 formed at two end portions for connecting adjacent slat parts 1 of one slat (S1). The connecting unit 12 includes complementary first and second connectors, 121 and 122. The first connector 121 includes a hook member 123 and a tenon 124 which extend in a longitudinal direction of the slat part 1 from one of the end portions. The second connector 122 includes a hook seat 128 and a mortise 127 formed at the other one of the end portions. The hook member 123 has a barbed end 125. The hook seat 128 projects from the rear side 101 of the slat part 1 and has a distal face which is formed with an engaging groove 126 that extends along the longitudinal direction of the slat part 1 and that is confined by a spaced pair of walls 129.

Figure 2:
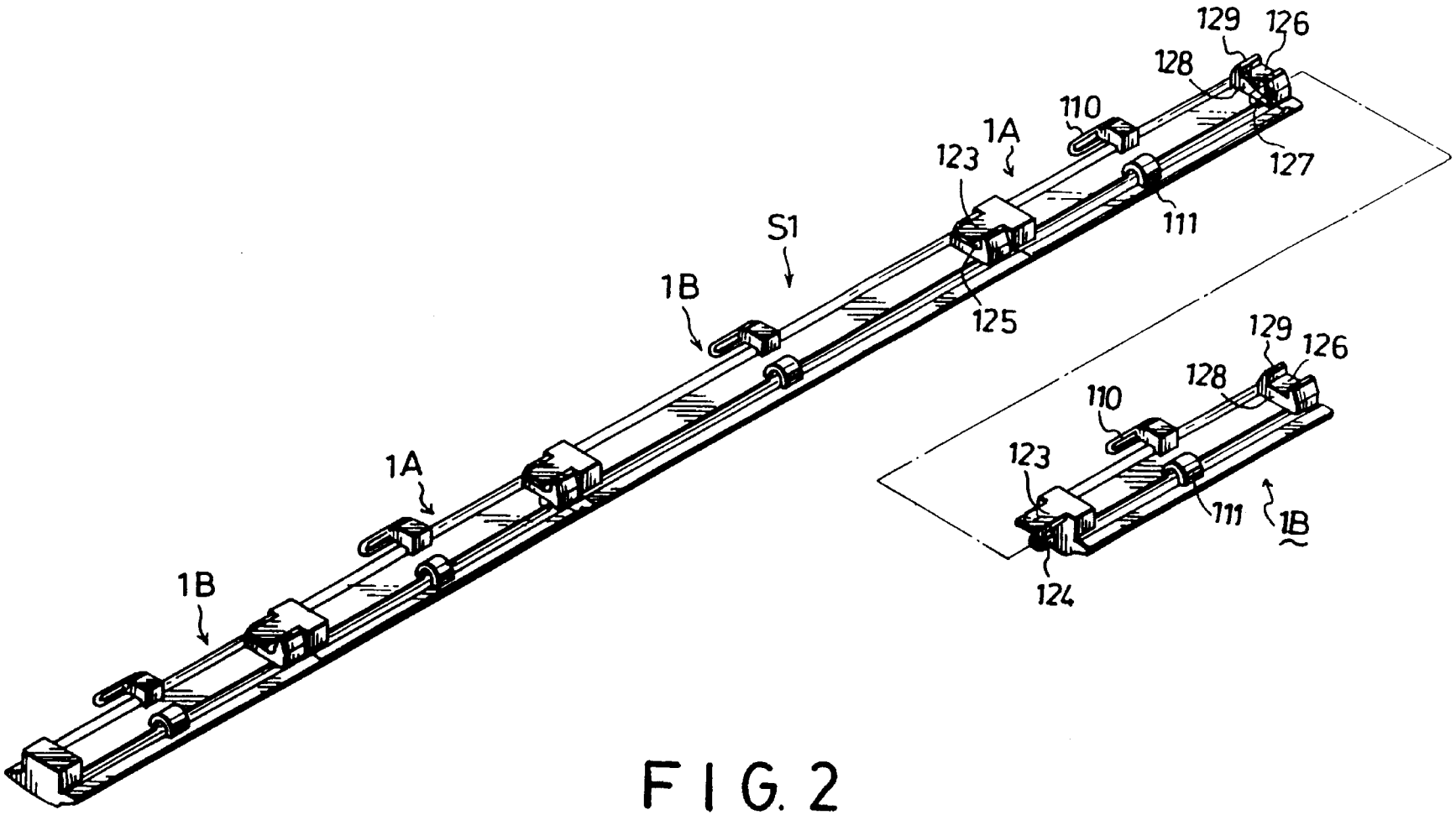
FIG. 2 is a partly exploded, rear perspective view illustrating how a slat of the preferred embodiment is assembled.
Figure 3:
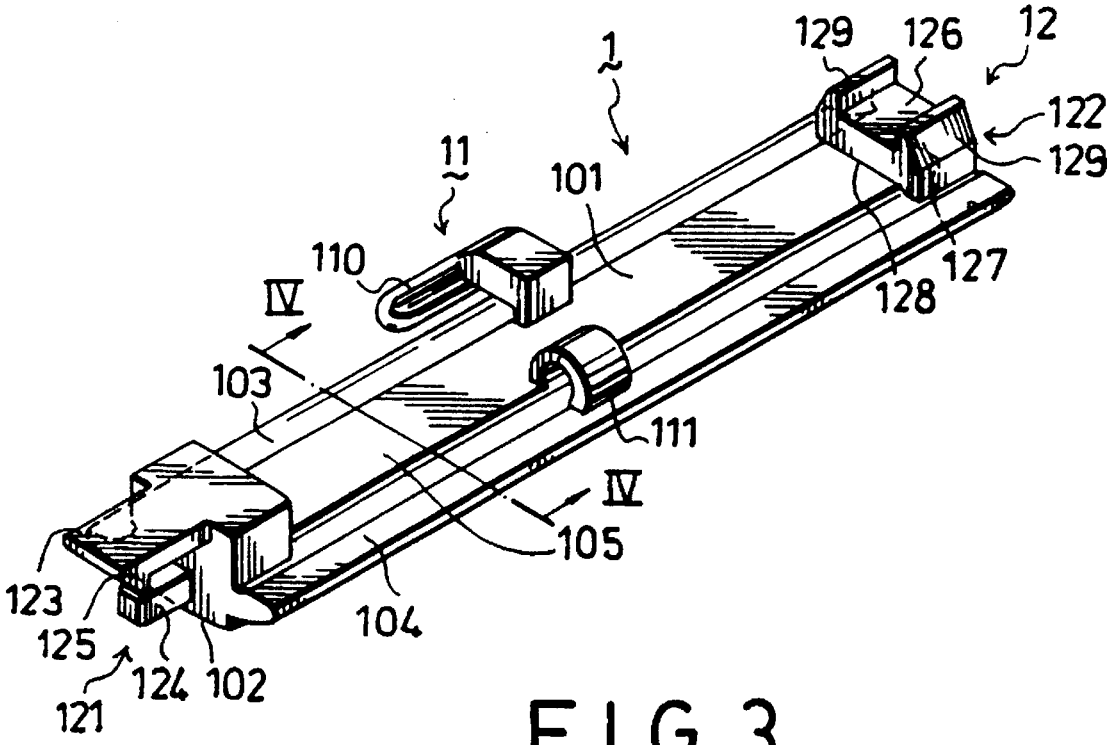
FIG. 3 is a rear perspective view of a slat part of the slat shown in FIG. 2.

In the preferred embodiment, there are two kinds of slat parts 1 employed in each slat (S1). Referring to FIG. 2, each of the slats (S1) comprises two transparent slat parts (1A) and three opaque slat parts (1B). The first connector 121 of each of the transparent slat parts (1A) engages the second connector 122 of one of the opaque slat parts (1B), while the second connector 122 of each of the transparent slat parts (1A) engages the first connector 121 of another one of the opaque slat parts (1B). Preferably, the transparent slat parts (1A) of adjacent slats (S1) are aligned with one another, as shown in FIG. 1. In this way, viewing of objects kept behind the shutter of the present invention is permitted so as to facilitate identification of the objects.

Referring to FIG. 4, the intermediate portion 105 of the slat parts 1 has a convex surface at the front side 102. Thus, the intermediate portion 105 of the transparent slat part (1A) can serve to magnify the object behind the same to facilitate viewing of the object.

It has thus been shown that the shutter of the present invention permits magnified viewing of objects kept behind the shutter so as to facilitate identification of the objects. In addition, since the shutter is only partially transparent, the aesthetic appeal of the cabinet which is installed with the shutter of the present invention can be enhanced.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A shutter for a cabinet comprising a plurality of juxtaposed slats, each of said slats including at least two longitudinally aligned slat parts with front and rear sides, each of said slat parts having longitudinal first and second portions, a longitudinal intermediate portion between said first and second portions, a pin-and-eye assembly provided on said rear side at said first and second portions and connecting pivotally adjacent slats of said plurality of slats, and complementary first and second connectors formed at two end portions, said connectors connecting adjacent slat parts of said slat parts of one of said slats in a longitudinal direction with respect to the adjacent slat parts, at least one of said slat parts of each of said slats being transparent, and said intermediate portion of said transparent slat part having a convex surface providing said transparent slat part with a magnifying capability.

2. The shutter as claimed in claim 1, wherein said transparent slat parts of adjacent ones of said slats are aligned with one another.

3. The shutter as claimed in claim 2, wherein said convex surface is at said front side of said slat.

4. The shutter as claimed in claim 1, wherein said pin-and-eye assembly includes a pin member provided at said first portion and extending in a longitudinal direction of said slat part and an eye member provided at said second portion, said pin member of one of said slat parts of one of said slats engaging said eye member of one of said slat parts of an adjacent one of said slats to connect pivotally said slats.

5. The shutter as claimed in claim 1, wherein said first connector includes a hook member which extends in a longitudinal direction of said slat part from one of said end portions, and said second connector includes a hook seat which is formed at the other one of said end portions and which engages said hook member of an adjacent one of said slat parts of said slat.

6. The shutter as claimed in claim 5, wherein said hook member has a barbed distal end.

7. The shutter as claimed in claim 5, wherein one of said first and second connectors further includes a tenon which extends in the longitudinal direction from one of said end portions, and the other one of said first and second connectors further includes a mortise which is formed in the other one of said end portions and which engages said tenon of the adjacent one of said slat parts of said slat.

8. A magnifying transparent slat part which has front and rear sides and which includes longitudinal first and second portions, a longitudinal intermediate portion located between said first and second portions and having a convex surface providing said transparent slat part with a magnifying capability, a pin-and-eye assembly provided on said rear side at said first and second portions, and complementary first and second connectors formed respectively at two end portions of said slat part said connectors connecting with an adjacent slat part in a longitudinal direction with respect to said adjacent slat part.

9. The transparent slat part as claimed in claim 8, wherein said convex surface is at said front side of said slat part.

10. The transparent slat part as claimed in claim 8, wherein said pin-and-eye assembly includes a pin member provided at said first portion and extending in a longitudinal direction of said slat part and an eye member provided at said second portion.

11. The transparent slat part as claimed in claim 8, wherein said first connector includes a hook member which extends in a longitudinal direction of said slat part from one of said end portions, and said second connector includes a hook seat which is formed at the other one of said end portions.

12. The transparent slat part as claimed in claim 11, wherein said hook member has a barbed distal end.

13. The transparent slat part as claimed in claim 11, wherein one of said first and second connectors further includes a tenon which extends in the longitudinal direction from one of said end portions and the other one of said first and second connectors further includes a mortise which is formed in the other one of said end portions.

* * * * *